United States Patent [19]

Mattei

[11] Patent Number: 4,653,516

[45] Date of Patent: Mar. 31, 1987

[54] METHOD FOR SIMULTANEOUSLY PRODUCING TWO CONTINUOUS STREAMS OF CIGARETTES

[75] Inventor: Riccardo Mattei, Bologna, Italy

[73] Assignee: G.D Societa' per Azioni, Bologna, Italy

[21] Appl. No.: 804,268

[22] Filed: Dec. 3, 1985

[30] Foreign Application Priority Data

Dec. 10, 1984 [IT] Italy ..... 3653 A/84

[51] Int. Cl.[4] ..... A24C 5/38; A24C 5/14; A24C 5/28

[52] U.S. Cl. ..... 131/284; 131/84.1; 131/65; 131/906; 83/74

[58] Field of Search ..... 131/284, 84.1, 84.3, 131/84.4, 905, 906, 908, 33, 34, 60, 65; 83/74, 76

[56] References Cited

U.S. PATENT DOCUMENTS

| | | | |
|---|---|---|---|
| 3,820,429 | 6/1974 | Harns, Jr. | 83/76 |
| 4,020,722 | 5/1977 | Byrt et al. | 83/74 |
| 4,147,078 | 4/1979 | Bishop | 83/74 |
| 4,267,752 | 5/1981 | Byrt et al. | 83/74 |
| 4,287,797 | 9/1981 | Seragnoli | 83/74 |
| 4,336,812 | 6/1982 | Seragnoli | 131/84.1 |
| 4,415,978 | 11/1983 | Craemer et al. | 83/74 |
| 4,583,557 | 4/1986 | Mattei et al. | 131/84.1 |
| 4,598,719 | 7/1986 | Mattei et al. | 131/84.1 |

*Primary Examiner*—Vincent Millin
*Assistant Examiner*—H. Macey
*Attorney, Agent, or Firm*—Marshall, O'Toole, Gerstein, Murray & Bicknell

[57] ABSTRACT

A method for producing two continuous streams of cigarettes in which a continuous paper web is cut longitudinally to form two strips which are fed through a tobacco loading device and along respective guides for forming respective continuous rods and then to a transverse cutting device by respective conveyor belts, the drive rollers of which are driven by a single motor by way of a differential unit controlled by devices for sensing the positions which graphical signs reproduced on the paper strips have reached on each operation of the transverse cutting device.

4 Claims, 4 Drawing Figures

METHOD FOR SIMULTANEOUSLY PRODUCING TWO CONTINUOUS STREAMS OF CIGARETTES

BACKGROUND OF THE INVENTION

This invention relates to a method for simultaneously producing two continuous streams of cigarettes.

U.S. Pat. No. 4,336,812 of the present applicant describes a production machine able to simultaneously produce two continuous cigarette rods starting from a single paper web, which is cut longitudinally to form two substantially identical strips. The said two strips are fed, by respective side-by-side conveyor belts driven by a common drive roller, along a forming bench for said rods by way of a loading station, in which a respective shredded tobacco filler is fed on to each strip.

One of the major functional drawbacks of the aforesaid machine derives from the use of said common drive roller, which implies identical dynamic behaviour of the two conveyor belts. This does not happen in practive, as one conveyor belt is never identical to another, with the result that when two theoretically equal belts are mounted along identical paths about a common drive roller, they advance, when in use, at speeds which especially after a certain period of operation can be different from each other.

Because of the fact that in the aforesaid machine the two strips for the two rods are produced from the same paper web, any difference in their speed of advancement can lead, if not immediately eliminated, to the tearing of at least one of said strips.

SUMMARY OF THE INVENTION

The object of the present invention is to simultaneously produce two streams of cigarettes without the aforesaid drawback occurring.

This object is attained according to the present invention by a method for simultaneously producing two continuous streams of cigarettes, characterised by comprising the following stages:

feeding a paper web through a printing unit in order to print on the web a succession of graphical signs disposed transversely to the central longitudinal axis of said web and each extending on opposite sides thereof; the distance, measured along said central axis, between adjacent graphical signs being equal to the length of one cigarette to be produced;

feeding the printed web to a first cutting device in order to cut the web along said central axis to obtain a first and second substantially identical paper strip, each said strip carrying a respective portion of each said graphical sign;

advancing said strips, respectively by means of a first and second conveyor belt, through a loading station in which a respective shredded tobacco filler is fed on to each said strip, and along a bench for forming respective continuous cigarette rods; said conveyor belts being provided with respective mutually independent drive rollers;

advancing said two rods through respective sensor devices arranged to emit, for each said rod, an electrical signal as each said portion of graphical sign passes by, in a determined position along said bench;

advancing said two rods through a second cutting device to transversely cut said rods in order to obtain said two continuous streams of cigarettes;

said second cutting device emitting a machine signal for each cutting operation;

obtaining, for each said rod, a phase signal by comparing, in terms of phase, each said machine signal with a relative said signal emitted by each said sensor device; and controlling the peripheral speed of said two drive rollers in such a manner as to keep said phase signals constantly equal to a determined reference signal.

BRIEF DESCRIPTION OF THE DRAWINGS

The invention is described hereinafter with reference to the accompanying drawings, which illustrate a non-limiting embodiment thereof, and in which.

DETAILED DESCRIPTION OF THE INVENTION

Figure 1:
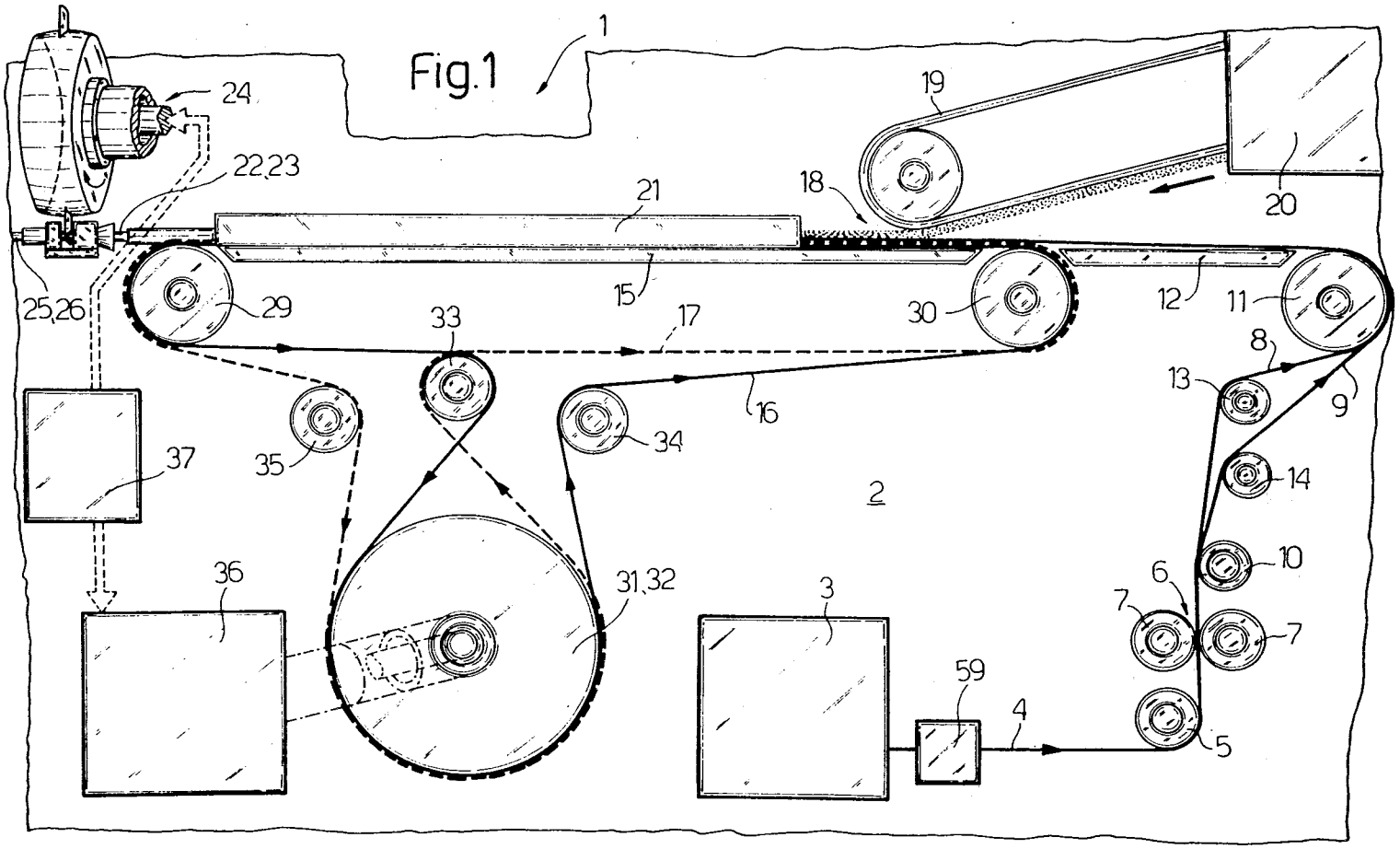
FIG. 1 is a partial diagrammatic view partly in block form of a cigarette production machine for implementing the method according to the present invention.

In FIG. 1, the reference numeral 1 indicates overall a cigarette production machine comprising a base 2 which supports a feed device 3 for a continuous web 4 of cigarette paper. Specifically, the web 4 is double the width of the webs normally used for forming continuous cigarette rods in production machines of the single rod type.

On leaving the device 3, the web 4 winds about a deviation roller 5, and then passes through a first cutting device 6 comprising two cutter discs 7 disposed tangentially in contact with each other to cut the web 4 along its longitudinal axis in order to obtain two substantially identical strips 8 and 9.

On leaving the cutting device 6, the strips 8 and 9 wind about a deviation roller 10 and then about a further deviation roller 11 which deviates them on to a substantially horizontal bench 12 supported in a fixed position by the base 2.

Two deviation rollers 13 and 14 are disposed between the rollers 10 and 11. For clarity of representation, the strips 8 and 9 are shown in FIG. 1 following two paths which are mutually offset where they make contact with the rollers 13 and 14, but in reality the strips 8 and 9 follow identical side-by-side paths along the spatial route between the rollers 10 and 11.

A second horizontal bench 15 substantially coplanar with the bench 12 is disposed downstream of the bench 12 in the direction of advancement of the strips 8 and 9 and supports the upper branches of two side-by-side conveyor belts 16 and 17 which, for clarity of representation, are shown in FIG. 1 by a full line in the case of the former and by a dashed line in the case of the latter.

During their advancement along the bench 15, the strips 8 and 9 pass through a loading station 18, in which a continuous shredded tobacco filler is fed on to each of the strips 8 and 9 by a suction conveyor belt 19 emerging from a feed unit 20 of known type.

Downstream of the loading station 18, the strips 8 and 9 engage the continuous cigarette rod forming means, constituted by respective guides 21 of curved cross-section with a gradually decreasing radius of curvature, so that in their final portion they assume a substantially cylindrical shape in known manner. In this way, the strips 8 and 9 are forced to bend transversely in known manner about the relative tobacco fillers, and to form two continuous cigarette rods indicated respectively by 22 and 23.

On leaving the bench 15, the two rods 22 and 23 are advanced through a second cutting device 24 of known type, which operates simultaneously on the said two rods to divide them into two continuous streams of cigarettes indicated by 25 and 26.

As shown in FIG. 1, the two belts 16 and 17 wind endlessly along paths which are of equal length, but which coincide with each other only partly so as to facilitate any maintenance work. In particular, both the belts 16 and 17 wind about common deviation rollers 29 and 30 disposed at the opposing ends of the bench 15, and about respective drive rollers 31 and 32 (FIG. 2).

In passing between the rollers 29 and 31 and between this latter and the roller 30, the belt 16 winds in the clockwise direction about a deviation roller 33 and about a tensioning roller 34 respectively. In contrast, in passing between the rollers 29 and 32 and between this latter and the roller 30, the belt 17 winds in the clockwise direction about a tensioning roller 35 and about the deviation roller 33 respectively.

The rollers 31 and 32 are rotated by drive means comprising a differential unit or device 36 connected to a single motor 37, which also operates the cutting device 24.

Figure 2:
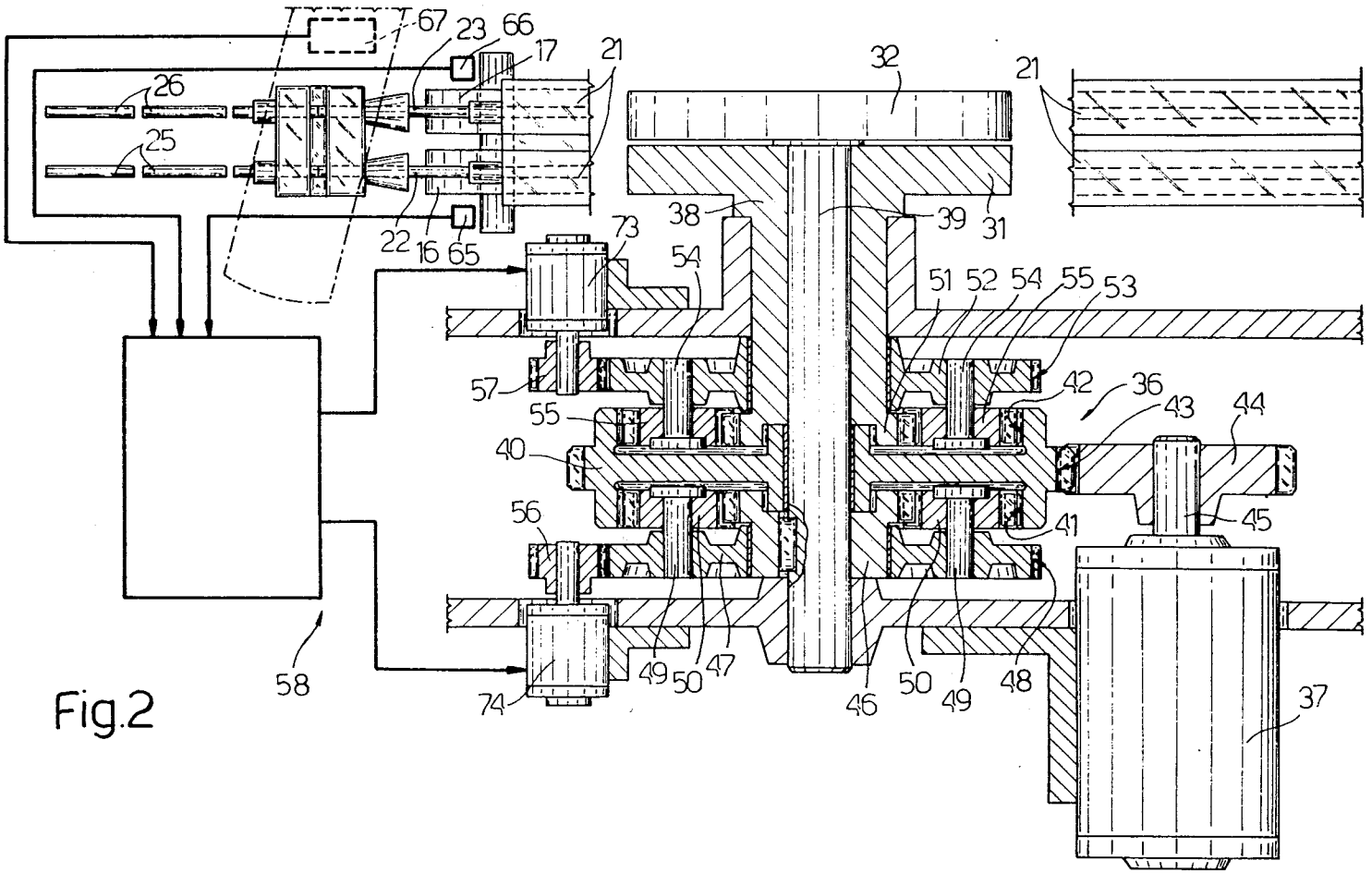
FIG. 2 is a diagrammatic illustration, partly in section and partly in block form, of a preferred embodiment of a detail of FIG. 1.

As shown in FIG. 2, the differential unit 36 comprises a hollow shaft 38 keyed at one end to the roller 31 and rotatably housing in its interior a shaft 39 which is coaxial to the shaft 38 and projects from it for keying to the roller 32. At its other end, the shaft 39 projects from the shaft 38 and idly supports a disc 40, on the outer periphery of which there are formed two internal ring gears 41 and 42 disposed on opposite sides of the disc 40, and external toothing 43 engaging with a gear wheel 44 keyed on to the output shaft 45 of the motor 37.

The shaft 39 also carries, keyed thereon, a sun gear 46 which rotatably supports a gear carrier 47 coaxial with it and provided with external peripheral toothing 48. In diametrically opposite positions, the gear carrier 47 supports two peripheral axial pins 49, on each of which a planet gear 50 is mounted, interposed between the sun gear 46 and ring gear 41.

On that end of the shaft 38 facing the disc 40, there is keyed a sun gear 51 which rotates with the shaft 38 and there is also idly mounted a gear carrier 52 disposed coaxial to the sun gear 51 and provided with external peripheral toothing 53 coaxial to the toothing 48 and substantially identical to it. In diametrically opposite positions, the gear carrier 52 supports two peripheral axial pins 54, on each of which a planet gear 55 is rotatably mounted, interposed between the sun gear 51 and ring gear 42. The toothings 48 and 53 engage with respective gears 56 and 57 constituting the outputs of a control circuit 58.

Figure 4:
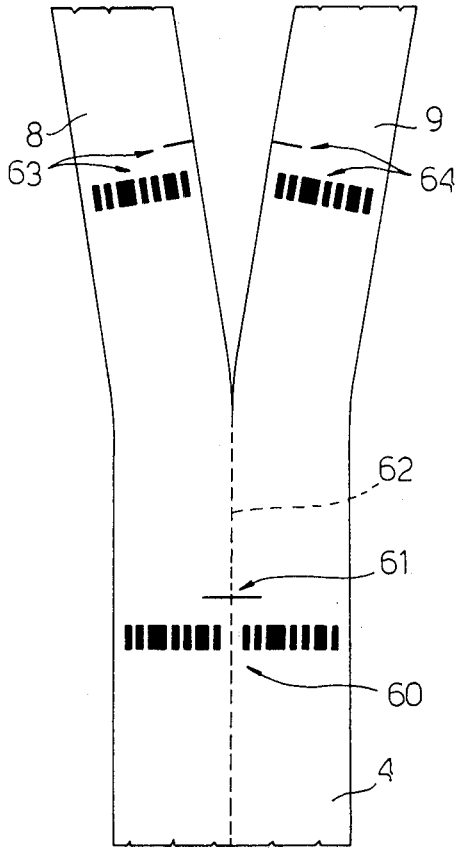
FIG. 4 is a plan view of a portion of the web used in the machine shown in the preceding figures.

As shown in FIG. 1, before reaching the roller 5 the web 4 passes through a printing unit 59 which, as shown in FIG. 4, is arranged to reproduce on the web 5 graphical signs which are each disposed, along the web 4, at a distance from the corresponding adjacent graphical sign which is equal to the length of one cigarette 25, 26 to be formed.

In the example shown in FIG. 4, the said graphical signs comprise two groups of signs indicated by 60 and 61, extending transversely to the central longitudinal axis 62 of the web 4 and each comprising a portion 63 and a portion 64 disposed symmetrically about the axis 62. The group 60 can consist for example of the name of the cigarette brand, whereas the group 61 can consist of a reference line extending transversely to the axis 62 and passing across it.

As shown in FIG. 2, between the guides 21 and cutting device 24 the bench 15 supports two sensor devices 65 and 66, which emit an electrical pulse every time a portion 63 and, respectively, a portion 64 of the group 61 passes in front of them.

The cutting device 24 comprises a sensor 67 arranged to emit an electrical pulse, indicated hereinafter by the term "machine signal or pulse", at each cutting operation and, together with the sensor devices 65 and 66, constituting the inputs of the control circuit 58.

Figure 3:
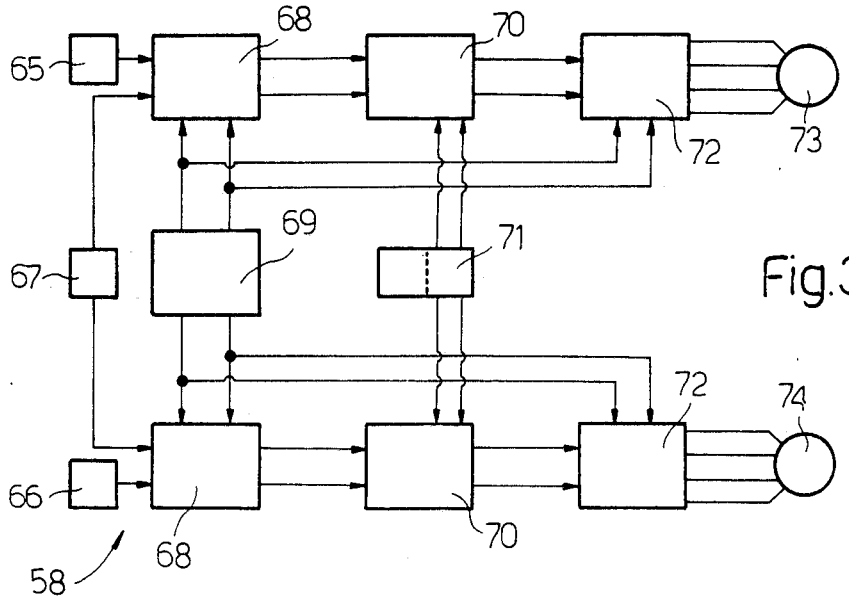
FIG. 3 is a circuit diagram of the control block of FIG. 1.

The control circuit 58 is described hereinafter with reference to FIG. 3, in which the reference numeral 68 indicates a block for quantifying the phase difference between a pulse emitted by the sensor 65 and a corresponding pulse emitted by the sensor 67.

As input, the quantifier block 68 receives the signals emitted by the sensors 65 and 67 and by a block 69 for generating timing and counting signals. In particular, the generator block 69 emits both a continuous train of counting pulses, and signals which define a succession of reading windows along said train of pulses. Within each reading window, each signal emitted by the sensor 67 finds its corresponding signal emitted by the sensor 65.

Having calculated the phase difference between the signals from the sensors 65 and 67 in each reading window, the quantifier block 68 emits a first digital signal indicative of the absolute value of this difference, and a second digital signal indicative of the sign of this difference.

The said two signals are fed to the inputs of a block 70 for calculating the difference between the phase difference signals emitted by the block 68 and an adjustable reference signal of determined value and sign emitted by a block 71.

The block 70 emits a first digital signal indicative of the absolute value of the calculated difference, and a second digital signal indicative of the sign of this difference. These two signals are received by a control block 72 for a stepping motor 73, the output shaft of which is keyed to the gear 57. The block 72 also receives the output signals of the block 69 in order to be able to emit, for each pair of corresponding signals emitted by the sensors 65 and 67, a train of command pulses which, received by the motor 73, enable this latter to reduce the signal emitted by the block 70 to zero.

The control circuit 58 also comprises a further series of blocks 68, 70 and 72 relative to the sensor 66 and connected in the aforesaid manner to the emitter 67 and to the blocks 69 and 71 in order to control an electric stepping motor 74, the output shaft of which is keyed to the gear 56.

The said blocks 68, 69, 70 and 72 are not described herein as they are of known type. However, for a better understanding of their structure and operation reference should be made to U.S. Pat. No. 4,287,797 of the present applicant, and to the description of the blocks indicated therein by the reference numerals 14, 22, 24 and 49.

From the aforegoing it is apparent that by means of the circuit 58 it is possible to always maintain the groups 61 in the correct position relative to the cutting device 24 when this latter carries out its cutting operation, resulting in extremely exact control not only of the position of each strip 8, 9 with respect to each other but also of the length of the cigarettes 25 and 26 obtained.

I claim:

1. A method for simultaneously producing two continuous streams of cigarettes (25, 26), characterised by comprising the following stages:

feeding a paper web (4) through a printing unit (59) in order to print on the web (4) a succession of graphical signs (60, 61) disposed transversely to the central longitudinal axis (62) of said web (4) and each extending on opposite sides thereof; the distance, measured along said central axis (62), between adjacent graphical signs (60; 61) being equal to the length of one cigarette (25, 26) to be produced;

feeding the printed web (4) to a first cutting device (6) in order to cut the web (4) along said central axis (62) to obtain a first (8) and second (9) substantially identical paper strip, each said strip (8, 9) carrying a respective portion (63, 64) of each said graphical sign (60, 61);

advancing said strips (8, 9), respectively by means of a first (16) and a second (17) conveyor belt, through a loading station (18) in which a respective shredded tobacco filler is fed on to each said strip (8, 9), and along a bench (15) for forming respective continuous cigarette rods (22, 23); said conveyor belts (16, 17) being provided with respective mutually independent drive rollers (31, 32);

advancing said two rods (22, 23) through respective sensor devices (65, 66) arranged to emit, for each said rod (22, 23), an electrical signal as each said portion (63, 64) of graphical sign (60 or 61) passes by, in a determined position along said bench (15);

advancing said two rods (22, 23) through a second cutting device (24) to transversely cut said rods (22, 23) in order to obtain said two continuous streams of cigarettes (25, 26); said second cutting device (24) emitting a machine signal for each cutting operation;

obtaining, for each said rod (22, 23), a phase signal by comparing in terms of phase each said machine signal with a relative said signal emitted by each said sensor device (65, 66); and controlling the peripheral speed of said two drive rollers (31, 32) in such a manner as to keep said phase signals constantly equal to a determined reference signal.

2. A method as claimed in claim 1, characterised in that said two drive rollers (31, 32) are connected to a differential device (36) having a first input connected to a drive motor (37), and two further inputs connected to two motors (73, 74) for controlling the peripheral speeds of said two drive rollers (31, 32); each said control motor (73, 74) being arranged to receive command signals which are functions of the difference between said phase signal relative to a respective said strip (8, 9) and said reference signal.

3. A method as claimed in claim 2, characterised in that said phase signals are digital signals, and said control motors (73, 74) are stepping motors.

4. A method as claimed in claim 1, characterised in that each said graphical sign comprises a reference line (61) drawn transversely to the central longitudinal axis of said web (4).

* * * * *